US006481334B1

(12) United States Patent
Kaneko

(10) Patent No.: US 6,481,334 B1
(45) Date of Patent: Nov. 19, 2002

(54) RODLESS CYLINDER

(75) Inventor: Junya Kaneko, Abiko (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/686,982

(22) Filed: Oct. 17, 2000

(30) Foreign Application Priority Data

Oct. 18, 1999 (JP) ..... 11-295396

(51) Int. Cl.[7] ..... F01B 11/02
(52) U.S. Cl. ..... 92/88; 92/85 R
(58) Field of Search ..... 92/88, 85 R, 165 PR, 92/177

(56) References Cited

U.S. PATENT DOCUMENTS 651,864 A * 6/1900 Kelly ..... 92/88
3,557,663 A * 1/1971 Florjancic ..... 91/394
5,568,982 A * 10/1996 Stoll et al. ..... 384/55
5,950,790 A * 9/1999 Barber ..... 92/88
5,992,295 A * 11/1999 Noda et al. ..... 92/88
6,092,456 A * 7/2000 Noda et al. ..... 92/88

FOREIGN PATENT DOCUMENTS

DE 24 31 706 1/1976
DE 195 31 523 4/1996

* cited by examiner

*Primary Examiner*—F. Daniel Lopez
(74) *Attorney, Agent, or Firm*—Paul A. Guss

(57) ABSTRACT

A cylinder tube which is a main part of a rodless cylinder is mounted with stopper members through end plates. The stopper members are provided with adjuster bolts to restrict the moving range of a slide table and shock absorbers to buffer impact given when the slide table collides with the adjuster bolts. The stopper members have inner ports provided at the end plates and outer ports in communication with the inner ports.

13 Claims, 7 Drawing Sheets

RODLESS CYLINDER

BACKGROUND OF THE INVENTION

1. Field of the Invention

The present invention relates to a rodless cylinder, and more specifically, to a rodless cylinder characterized by the manner of attaching a stopper member to restrict the moving range of a slide table.

2. Description of the Prior Art

A rodless cylinder is conventionally employed as a transfer device for a workpiece in a factory or the like. The rodless cylinder has a shorter length than a cylinder having a rod, considering a displacement length. Therefore, the rodless cylinder occupies a smaller area, and is easy to handle. Further, it allows a high level positioning operation or the like.

The rodless cylinder mainly includes a cylinder tube having a bore, a piston provided in the bore, and a slide table coupled to the piston to reciprocate along the cylinder tube with the movement of the piston.

The rodless cylinder also includes a stopper member to restrict the moving range of the slide table. In this case, the stopper member is mounted to the cylinder tube.

In recent years, there has been a demand for shorter and thinner rodless cylinders, but the space for mounting the stopper member must be secured in the cylinder tube, which makes it difficult to reduce the length. It would be difficult to even mount the stopper member thereon, if also the thickness of the rodless cylinder must be reduced.

SUMMARY OF THE INVENTION

It is a general object of the present invention to provide a thinner and shorter rodless cylinder while securing the space for mounting a stopper member.

It is a main object of the present invention to secure the space for mounting the adjuster bolt and the shock absorber, while the cylinder tube can be thinned.

Furthermore, the end plate includes an inner port in communication with the bore, and the stopper member includes an outer port in communication with the inner port. Thus, the inner port can be prevented from being blocked by the stopper member and becoming unusable.

DESCRIPTION OF THE PREFERRED EMBODIMENTS

Figure 1:
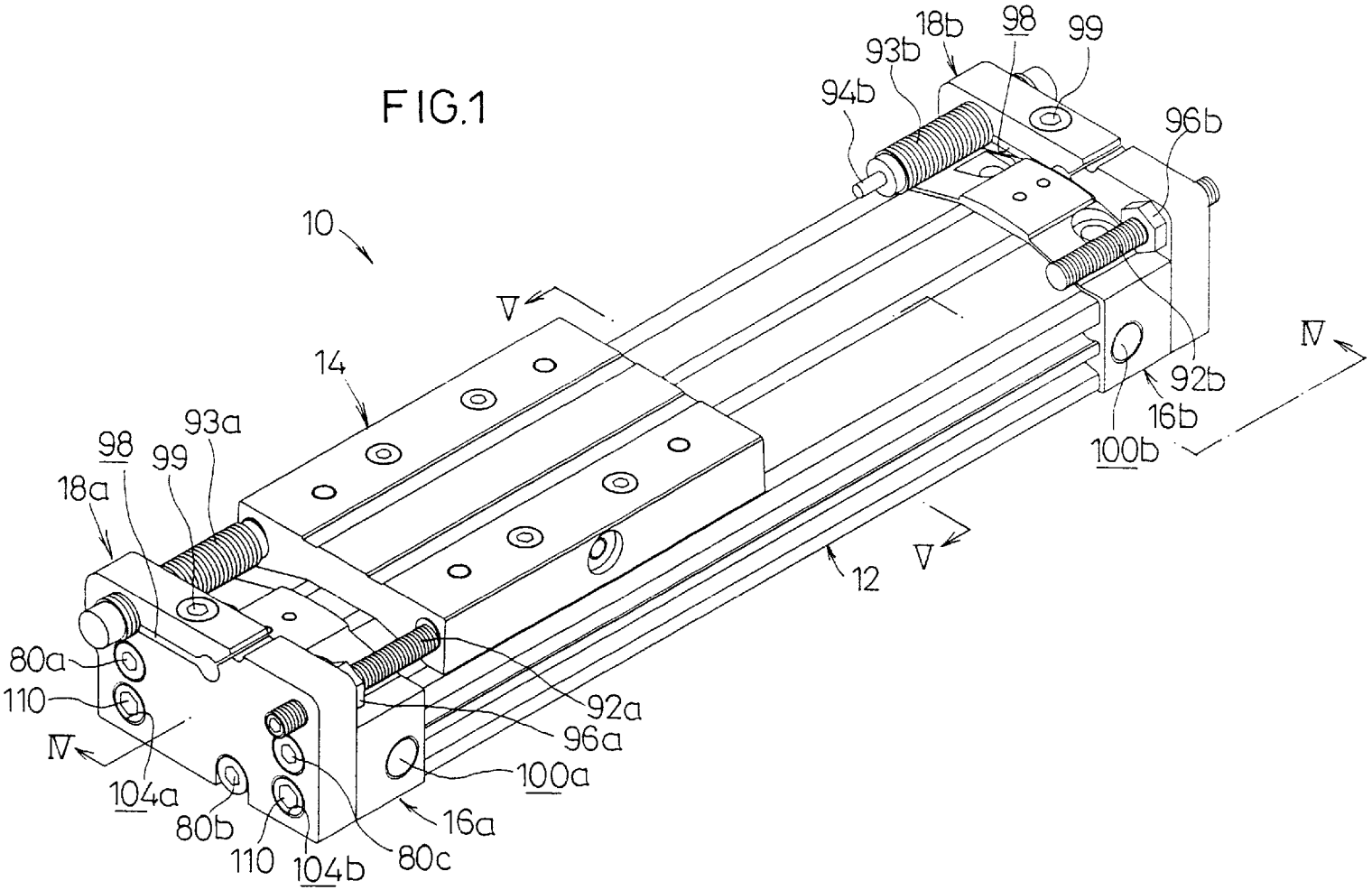
FIG. 1 is a perspective view of the general structure of a rodless cylinder according to an embodiment of the present invention.

FIG. 1 shows a rodless cylinder 10 according to the present embodiment. The rodless cylinder 10 includes a cylinder tube 12, a slide table 14 attached to the cylinder tube 12 and capable of advancing/withdrawing in the longitudinal direction, end plates 16*a*, 16*b* attached at both ends of the cylinder tube 12, and stopper members 18*a*, 18*b* attached to the cylinder tube 12 through these end plates 16*a*, 16*b*.

Figure 2:
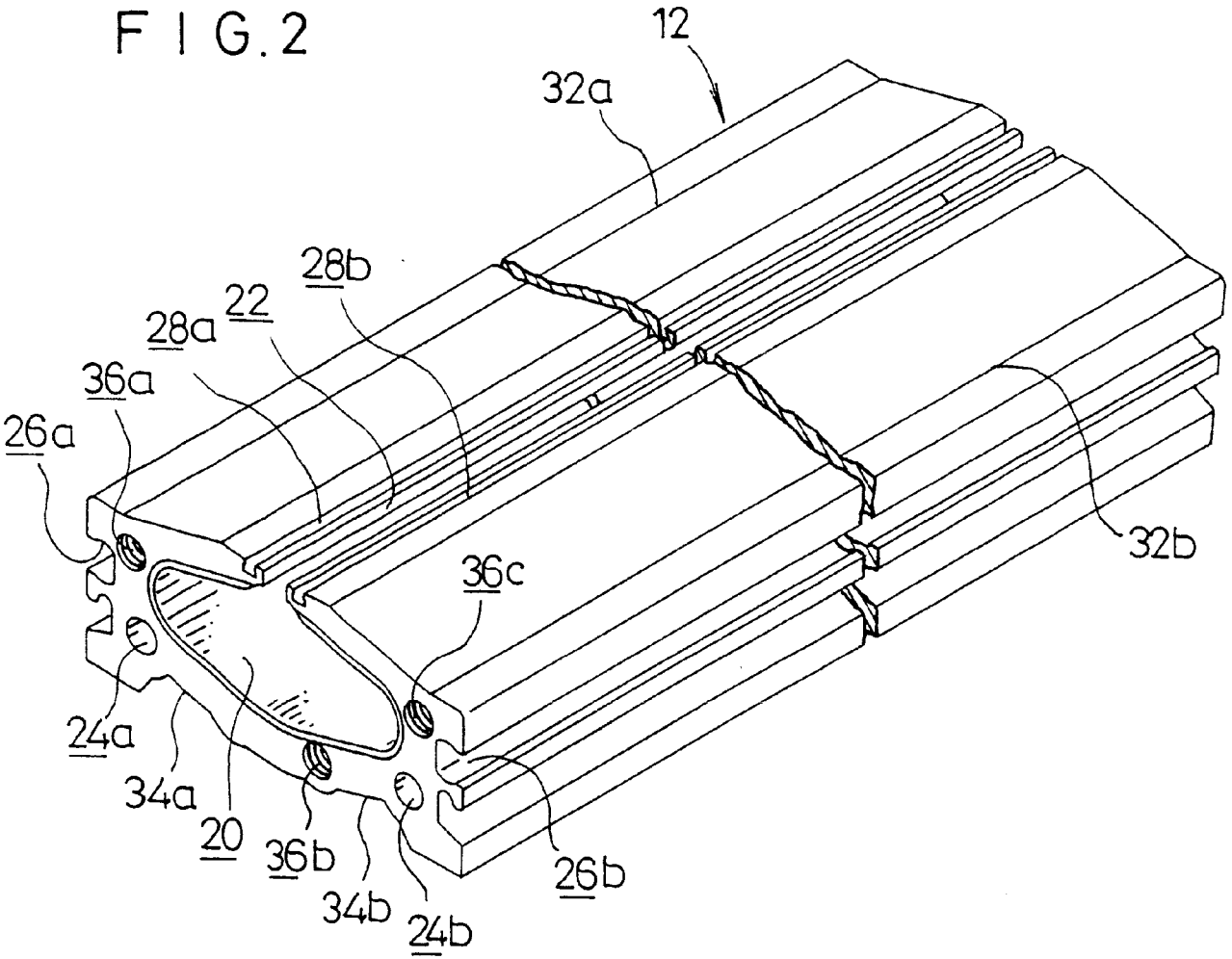
FIG. 2 is a perspective view of a cylinder tube which is a main part of the rodless cylinder shown in FIG. 1.
Figure 3:
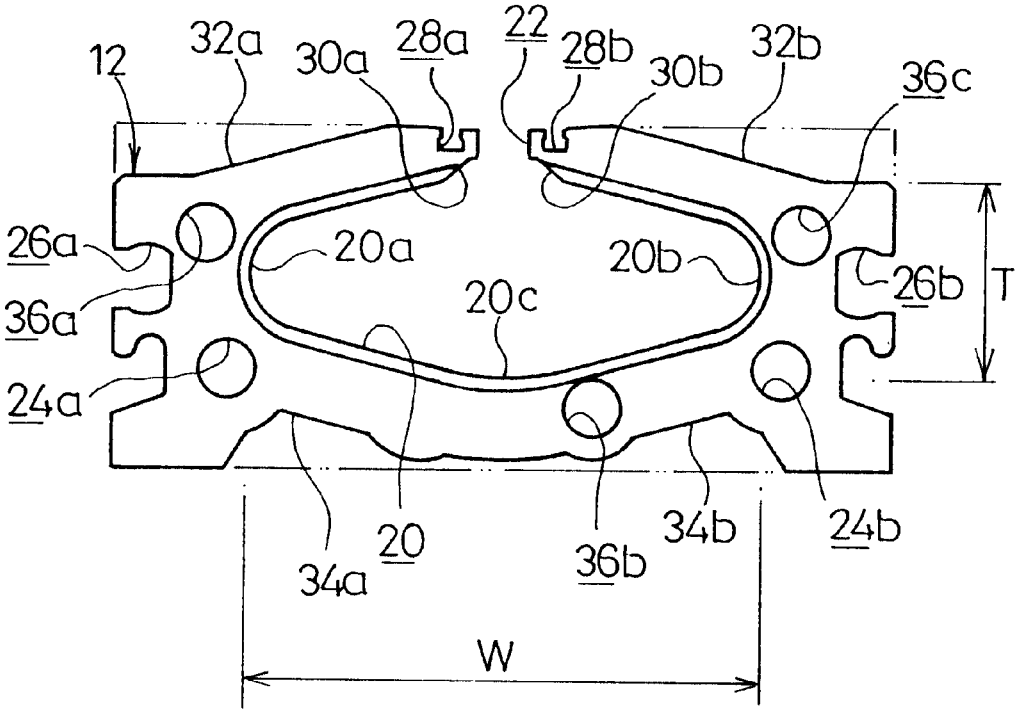
FIG. 3 is a side view of the cylinder tube in FIG. 2 viewed from an end side.

As shown in FIGS. 2 and 3, there is a bore 20 formed in the longitudinal direction in the cylinder tube 12. There is a slit 22 formed in the longitudinal direction at the upper surface of the cylinder tube 12, and the bore 20 is in communication with the outside through the slit 22. In the cylinder tube 12, in the vicinity of the lower side at both sides of the bore 20, fluid bypass passages 24*a*, 24*b* for centralized piping are formed along the bore 20.

At both side surfaces of the cylinder tube 12, elongate grooves 26*a*, 26*b* for attaching a sensor are formed in the longitudinal direction. The elongate grooves 26*a*, 26*b* for attaching a sensor are provided with a sensor or the like (not shown) used to detect the position of a piston 50 described later. At the upper surface of the cylinder tube 12, provided on both sides of the slit 22 are belt mounting grooves 28*a*, 28*b* for mounting an upper belt 64 described later. The belt mounting grooves 28*a*, 28*b* extend in the longitudinal direction of the cylinder tube 12.

As shown in FIG. 3, the bore 20 is formed to have an approximately rhombic cross section. More specifically, the thickness (height) of the bore 20 on both lateral sides is smaller than that of the central part thereof. The rhombic cross section of the bore 20 has a thickness T smaller than the width W.

In this case, the values of the thickness T and the width W are preferably set so that the ratio of the thickness relative to the width approximately perpendicular to the axial line in the cylinder tube 12 is about 50% or less.

Furthermore, the corner portions 20*a* to 20*c* of the rhombic cross section of the bore 20 are each formed to be approximately circular. The radius of curvature of the corner portion 20*c* is set to be larger than the radius of curvature of the other corner portions 20*a* and 20*b*. Taper portions 30*a*, 30*b* are formed to be tapered toward the outside at the borders of the bore 20 and the slit 22.

At the upper surface of the cylinder tube 12, formed in the vicinity of both sides of the bore 20 are thinned portions 32*a*, 32*b* having the corner portions removed from the rectangle (the double dotted chain line in FIG. 3) circumscribing the cylinder tube 12. Similarly, at the lower surface of the cylinder tube 12, formed in the vicinity of both sides of the bore 20 are thinned portions 34*a*, 34*b* having their thickness reduced into recesses removed from the rectangle circumscribing the cylinder tube 12.

At both ends of the cylinder tube 12, screw holes 36*a* to 36*c* to attach the end plates 16*a*, 16*b* and the stopper members 18*a*, 18*b* are formed.

In this case, except for the positions where the screw holes 36*a* to 36*c* are formed, the cylinder tube 12 is formed in approximate symmetry, more specifically in approximate symmetry relative to a plane extending through the center of the slide table 14 and the cylinder tube 12 in the moving direction of the slide table 14.

Note that the cylinder tube 12 is formed for example by extruding a metal material such as aluminum and an aluminum alloy.

Figure 4:
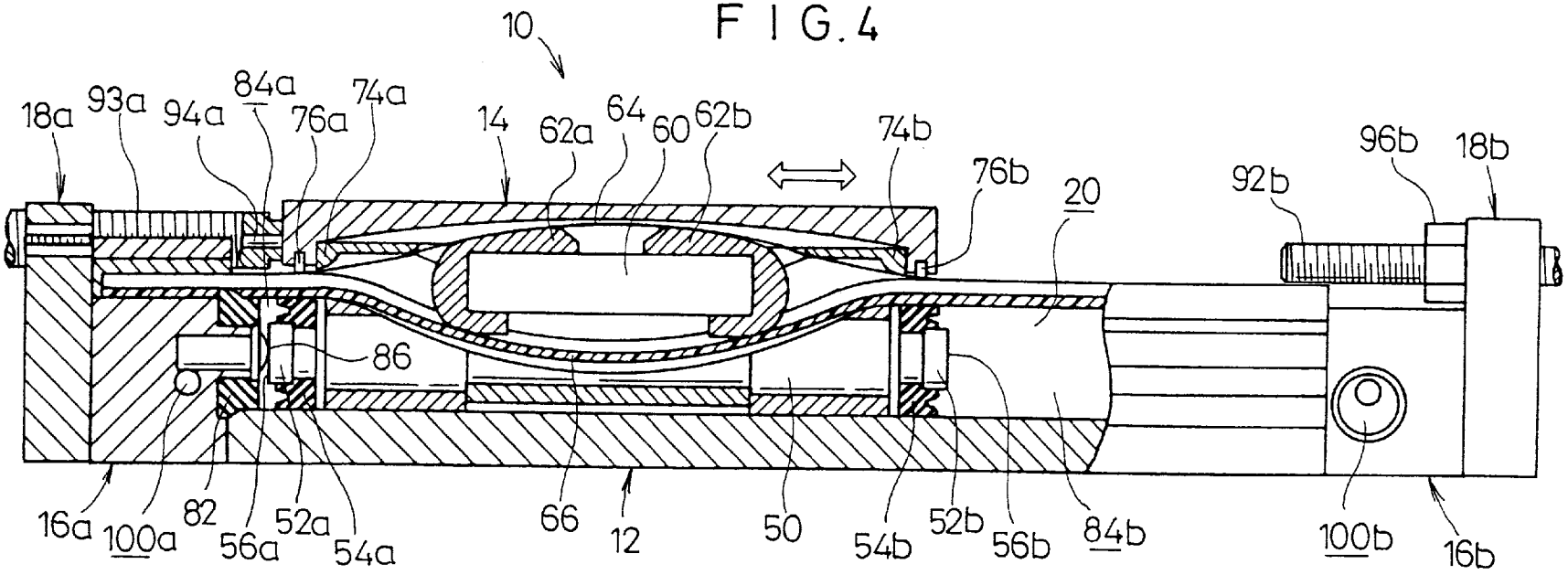
FIG. 4 is a longitudinal sectional view of the rodless cylinder shown in FIG. 1 taken along line IV—IV.

As shown in FIG. 4, the piston 50 having a cross section corresponding to the bore 20 is inserted in the bore 20 of the cylinder tube 12 and the piston can reciprocate therein.

Figure 5:
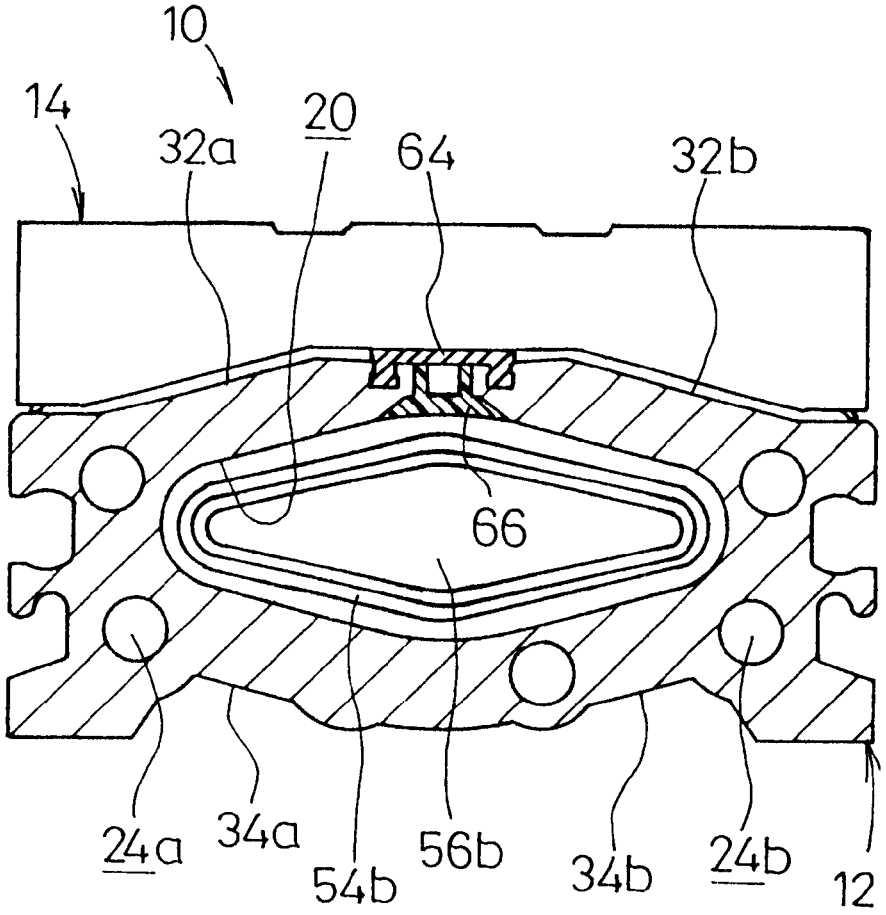
FIG. 5 is a longitudinal sectional view of the rodless cylinder shown in FIG. 1 taken along line V—V.

As shown in FIGS. 4 and 5, projections 52*a*, 52*b* are formed on both ends in the longitudinal direction of the piston 50. The projections 52*a* and 52*b* are attached with seal members 54*a* and 54*b*, respectively. In this case, the end surfaces of the projections 52*a* and 52*b* serve as pressure receiving surfaces 56*a* and 56*b*, respectively.

As shown in FIG. 5, the peripheral shape of the seal members 54*a* and 54*b* corresponds to the cross sectional shape of the bore 20, and is formed into an approximately rhombic shape with circular corners. As a result, the seal members 54*a* and 54*b* seal the space between the piston 50 and the inner wall surface of the bore 20.

As shown in FIG. 4, the piston 50 is provided with a yoke 60 projecting to the upper side, and at both ends of the piston yoke 60 on the upper side, a pair of belt separators 62*a*, 62*b* are attached with a predetermined distance therebetween. The piston 50 is coupled with the slide table 14 to cover the piston yoke 60 and the belt separators 62*a* and 62*b*. In this case, the slide table 14 is in contact with the upper surface of the cylinder tube 12 for example, through a guide mechanism which is not shown.

As shown in FIGS. 4 and 5, the slit 22 in the cylinder tube 12 is attached with the upper and lower belts 64 and 66 for sealing to block the slit 22 from the top and the bottom. For example, the upper belt 64 is formed of a rubber material or a resin material, while the lower belt 66 is formed of a resin material.

Figure 6:
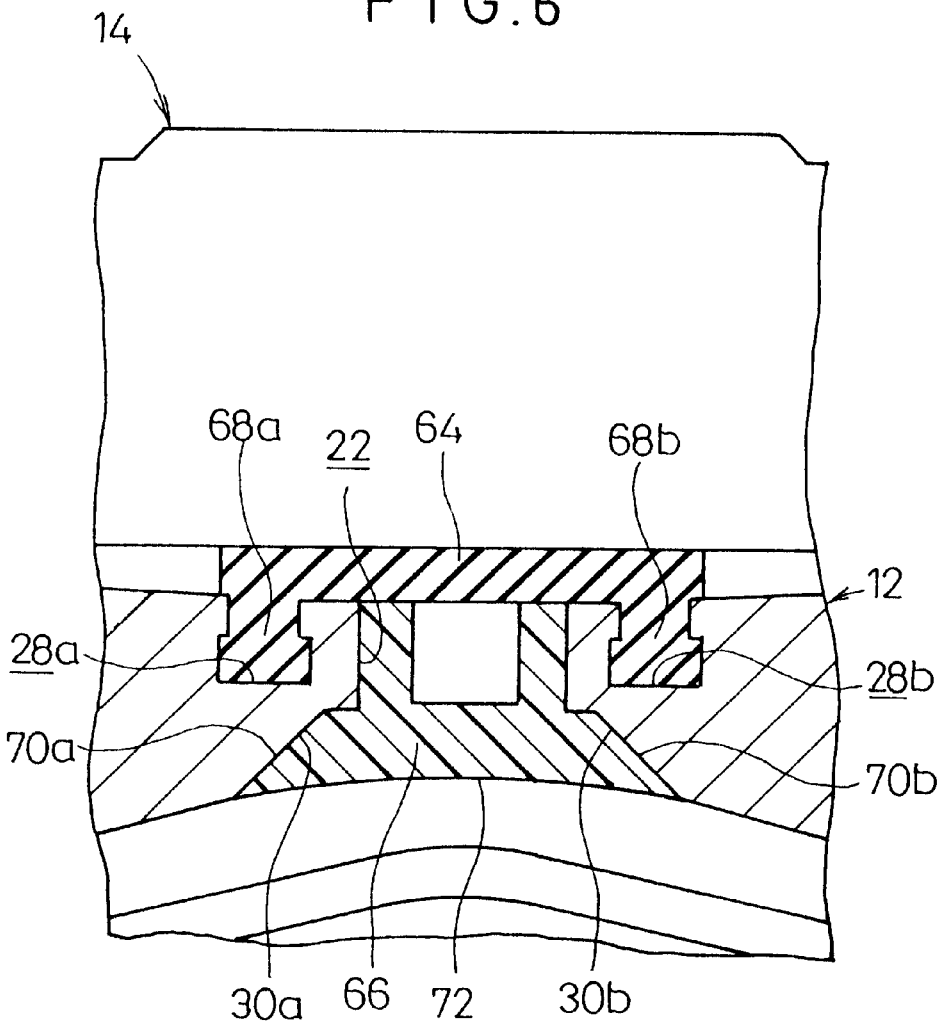
FIG. 6 is a partly enlarged, longitudinal sectional view showing the vicinity of a slit in the rodless cylinder in FIG. 5.

FIG. 6 is an enlarged view of the vicinity of the slit 22 in FIG. 5. As shown in FIG. 6, the upper belt 64 is provided with leg portions 68*a*, 68*b*. The upper belt 64 is mounted to the cylinder tube 12 by fitting the leg portions 68*a* and 68*b* into the belt mounting grooves 28*a*, 28*b* of the cylinder tube 12, respectively. Further, it is preferable that the upper belt 64 separably comprises a flat plate made of stainless steel and legs made of magnetic material allowing the flat plate to be magnetically attached to the legs.

On both sides at the upper surface of the lower belt 66, taper portions 70*a*, 70*b* formed corresponding to the taper portions 30*a*, 30*b* of the cylinder tube 12 are provided. The lower belt 66 is mounted to the cylinder 12 such that the taper portions 70*a*, 70*b* and the taper portions 30*a*, 30*b* are in a close contact state.

The lower surface portion 72 of the lower belt 66 is formed into a circular shape corresponding the circular shape of the upper ends (upper corner portions) of the seal members 54*a*, 54*b*. As a result, the space between the lower belt 66 and seal members 54*a*, 54*b* is sealed.

As shown in FIG. 4, both ends of the upper and lower belts 64 and 66 (only the left side is shown in FIG. 4) are secured to the end plates 16*a*, 16*b*, respectively.

The belt separators 62*a*, 62*b* are held between the upper belt 64 and the lower belt 66 apart from one another in the vertical direction. In this case, the upper belt 64 is passed through the space formed between the belt separators 62*a*, 62*b* and the slide table 14, while the lower belt 66 is passed through the space formed between the belt separators 62*a*, 62*b* and the piston 50.

On both end sides of the slide table 14, there are restraining members 74*a*, 74*b*, which press the upper belt 64 toward the cylinder tube 12.

More specifically, as described later, when the slide table 14 moves, the belt separators 62*a*, 62*b* act to separate (open) the upper and lower belts 64 and 66 from one another, while the restraining members 74*a*, 74*b* act to bring together (close) the upper and lower belts 64 and 66.

On both ends of the slide table 14, there are scrapers 76*a*, 76*b* in contact with the upper belt 64, and the scrapers 76*a*, 76*b* prevent dust from coming into the space between the slide table 14 and the upper belt 64.

Figure 7:
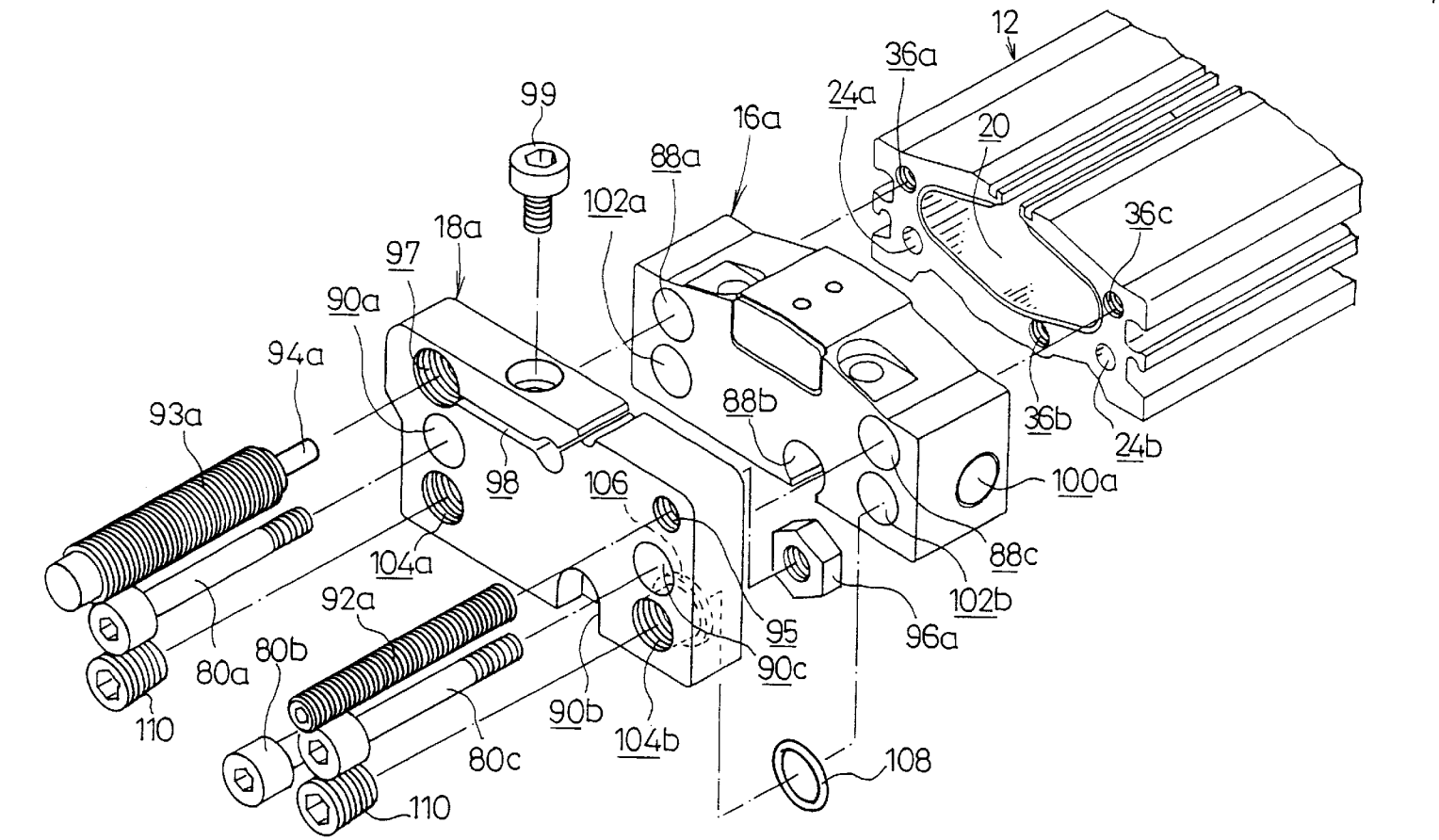
FIG. 7 is an exploded perspective view of the cylinder tube, an end plate and a stopper member forming an end side of the rodless cylinder in FIG. 1.

FIG. 7 is an exploded perspective view showing the cylinder tube 12, the end plates 16*a*, 16*b* and the stopper members 18*a*, 18*b* forming the end side of the rodless cylinder 10. Note that in FIG. 7, only the left end of the rodless cylinder 10 (the end plate 16*a* and the stopper member 18*a*) is shown.

As shown in FIGS. 4 and 7, the end plates 16*a* and 16*b* are attached to both ends of the cylinder tube 12 so as to block the openings of the bore 20. In this case, as shown in FIG. 7, the end plates 16*a*, 16*b* are attached to the cylinder tube 12 integrally with the stopper members 18*a*, 18*b* by mounting screw members 80*a* to 80*c* to the screw holes 36*a* to 36*c*. Note that how the end plates 16*a*, 16*b* and the stopper members 18*a*, 18*b* are specifically attached will be described later.

As shown in FIG. 4, the space between the end plates 16*a*, 16*b* and the bore 20 is blocked in an airtight manner by 6 a gasket 82 formed of a rubber material or the like. (In FIG. 4, only the side of the end plate 16*a* is shown.) As a result, chambers 84*a*, 84*b* are formed between the end plate 16*a* (gasket 82) and the piston 50 (pressure receiving surface 56*a*), and between the end plate 16*b* (another gasket which is not shown) and the piston 50 (pressure receiving surface 56*b*), respectively.

In the part of the gasket 82 facing the bore 20, a projection 86 is provided. In this case, this projection 86 may be abutted against the end of the piston 50 (pressure receiving surfaces 56*a*, 56*b*). More specifically, the projection 86 can buffer the impact given when the piston 50 advances/withdraws to reach the ends of the bore 20 and comes into contact with the end plates 16*a*, 16*b*.

As shown in FIG. 7, screw through holes 88*a* to 88*c* are formed in the end plates 16*a*, 16*b*. Screw mounting holes 90*a* to 90*c* are formed in the stopper members 18*a*, 18*b*. The end plates 16*a*, 16*b* and the stopper members 18*a*, 18*b* are attached integrally to the cylinder tube 12 by mounting the screw members 80*a* to 80*c* to the screw holes 36*a* to 36*c* of the cylinder tube 12 through the screw mounting holes 90*a* to 90*c* and the screw through holes 88*a* to 88*c*.

In this case, the stopper members 18*a*, 18*b* are provided on the outer side of the end plates 16*a*, 16*b* relative to the cylinder tube 12. More specifically, the stopper members 18*a*, 18*b* are mounted to the cylinder tube 12 through the end plates 16*a*, 16*b*.

As shown in FIGS. 1 and 7, the stopper members 18*a*, 18*b* are provided with adjuster bolts 92*a*, 92*b* to restrict the moving range of the slide table 14 and shock absorbers 93*a*, 93*b* to buffer the impact given when the slide table 14 contacts with the adjuster bolts 92*a*, 92*b*.

At the tip ends of the shock absorbers 93*a*, 93*b*, there are protrusions 94*a*, 94*b* capable of freely advancing/withdrawing in the direction of the shock absorbers 93*a*, 93*b* and urged in the direction toward the tip end by a spring member or the like which is not shown.

As shown in FIG. 7, the stopper members 18*a*, 18*b* have bolt mounting holes 95, and the adjuster bolts 92*a*, 92*b* are screwed into the bolt mounting holes 95, so that the adjuster bolts 92*a*, 92*b* are attached to the stopper members 18*a*, 18*b*.

As shown in FIGS. 1 and 7, the adjuster bolts 92*a*, 92*b* are provided with nut members 96*a*, 96*b*, which determine the tip end positions of the adjuster bolts 92*a*, 92*b*.

As shown in FIG. 7, the stopper members 18*a*, 18*b* have shock absorber mounting holes 97, into which the shock absorbers 93*a*, 93*b* are screwed, so that the shock absorbers 93*a*, 93*b* are attached to the stopper members 18*a*, 18*b*.

Further, as shown in FIGS. 1 and 7, the stopper members 18*a*, 18*b* have slit portions 98 along the upper surface of the stoppers 18*a*, 18*b* to be in communication with the shock absorber mounting holes 97. Screw members 99 are attached from the upper surface of the stopper members 18*a*, 18*b* through the slit portions 98, and the screw members 99 can apply force in the direction to reduce the width of the slit portions 98, such that the shock absorbers 93*a*, 93*b* are secured to the stopper members 18*a*, 18*b*.

In this case, the positions to attach the adjuster bolts 92*a*, 92*b*, and the shock absorbers 93*a*, 93*b* at the stopper members 18*a*, 18*b* are adjusted such that the adjuster bolts 92*a*, 92*b*, and the shock absorbers 93*a*, 93*b* are provided along the thinned portions 32*a*, 32*b*, respectively.

As shown in FIG. 1, ports 10*a*, 100*b* are formed at the side surfaces of the end plates 16*a*, 16*b*, respectively. These ports 100*a*, 100*b* are in communication with the chambers 84*a*, 84*b* (see FIG. 4), respectively in the cylinder tube 12 through passages (not shown) in the end plates 16*a*, 16*b*.

These ports 100*a*, 100*b* are connected with a compressed air supply source through for example a selector valve which is not shown. Compressed air from the compressed air supply source is selectively supplied to the ports 100*a*, 100*b*.

As shown in FIG. 7, at the end surfaces of the end plates 16*a*, 16*b*, ports (inner ports) 102*a*, 102*b* are formed, and these ports 102*a*, 102*b* are in communication with the chambers 84*a* or 84*b* (see FIG. 4) in the cylinder tube 12 through passages (not shown) in the end plates 16*a*, 16*b* or through the fluid bypass passages 24*a*, 24*b* provided in the cylinder tube 12.

Furthermore, the stopper members 18*a*, 18*b* have ports (outer ports) 104*a*, 104*b*, which are in communication with the inner ports 102*a*, 102*b* of the end plates 16*a*, 16*b*.

In this case, at the periphery toward the end plates 16*a*, 16*b* of each of the outer ports 104*a*, 104*b* located on the side surfaces of the stopper members 18*a*, 18*b*, an O-ring seat 106 is formed, and an O-ring 108 mounted to the O-ring seat 106 seals the space between the inner ports 102*a*, 102*b* and the outer ports 104*a*, 104*b*. (In FIG. 7, only the side of outer port 104*b* is shown.)

Note that the outer ports 104*a*, 104*b* are blocked by sealing screws 110.

The operation of the rodless cylinder 10 having the above-described structure will be now described.

As shown in FIGS. 1 and 4, one port 10*a* is supplied with compressed air, which is then introduced into the chamber 84*a* of the cylinder tube 12 through a passage which is not shown. As the compressed air presses the piston 50 to the right in FIG. 4, the slide table 14 moves to the right with the piston 50.

At this time, the upper and lower belts 64 and 66 which have been brought together by the restraining member 74*b* are separated by the belt separator 62*b* as the slide table 14 moves.

The upper and lower belts 64 and 66 in the vicinity of the center of the slide table 14 which have been separated by the belt separators 62*a*, 62*b* are brought together by the restraining member 74*a* as the slide table 14 moves.

More specifically, the slide table 14 is moved by the upper and lower belts 64 and 66 along the cylinder tube 12 while sealing the slit 22 and keeping the bore 20 airtight.

Upon reaching the right end of the cylinder tube 12, the slide table 14 contacts with the protrusion 94*b* provided at the tip end of the shock absorber 93*b*. At this time, the moving speed of the slide table 14 is reduced by oil hydraulic resistance applied upon a piston member (not shown) coupled to the protrusion 94*b*.

When the slide table 14 further moves and comes into contact with the tip end of the adjuster bolt 92*b*, the slide table 14 stops at that position.

When the port to supply the compressed air is switched between the ports 10*a* and 10*b*, i.e., when the compressed air is supplied from the other port 10*b*, the compressed air is introduced into the chamber 84*b* in the cylinder tube 12 through a passage which is not shown. As the compressed air presses the piston 50 to the left in FIG. 4, the slide table 14 moves to the left with the piston 50.

At this time, as opposed to the case in which the slide table 14 moves to the right, the upper and lower belts 64 and 66 which have been brought together by the restraining member 74*a* are separated by the belt separator 62*a*.

Meanwhile, the upper and lower belts 64 and 66 which have been separated by the belt separators 62*a*, 62*b* are brought together by the restraining member 74*b*.

Upon reaching the left end of the cylinder tube 12, the slide table 14 contacts with the tip end of the adjuster bolt 94*a* and stops. At this time, the impact given by the contact of the slide table 14 and the adjuster bolt 94*a* is buffered by the protrusion 94*a* provided at the tip end of the shock absorber 93*a*.

As in the foregoing descriptions, in the rodless cylinder 10 according to the present embodiment, the stopper members 18*a*, 18*b* to which the adjuster bolts 92*a*, 92*b* and shock absorbers 93*a*, 93*b* are attached are provided on the outer side of the end plates 16*a*, 16*b* relative to the cylinder tube 12. Therefore, the space to mount the stopper members 18*a*, 18*b* in the cylinder tube 12 is not necessary. As a result, the length of the cylinder tube 12, hence the length of the rodless cylinder 10 can be reduced in the longitudinal direction.

In this case, the cylinder tube 12 is thinned by forming the bore 20 to have an approximately rhombic shape. The adjuster bolts 92*a*, 92*b* and shock absorbers 93*a*, 93*b* are provided along the thinned portions 32*a*, 32*b*. Therefore, the cylinder tube 12 can be thinned and at the same time the mounting space for the stopper members 18*a*, 18*b* can be secured.

Furthermore, since the adjuster bolts 92*a*, 92*b* and the shock absorbers 93*a*, 93*b* are provided along the thinned portion 32*a*, 32*b*, the level of the upper surfaces of the stopper members 18*a*, 18*b* (the length projecting from the upper surface of the cylinder tube 12) can be lower than the level of the upper surface of the slide table 14, so that the entire rodless cylinder 10 can be thinned (see FIG. 4).

In addition, the end plates 16*a*, 16*b* and the stopper members 18*a*, 18*b* are integrally attached to the cylinder tube 12. As a result, the operation of assembling the cylinder tube 12, the end plates 16*a*, 16*b* and the stopper members 18*a*, 18*b* can be simplified.

The stopper members 18*a*, 18*b* have outer ports 104*a*, 104*b* in communication with the inner ports 102*a*, 102*b* provided at the end surfaces of the end plates 16*a*, 16*b*. As a result, if the stopper members 18*a*, 18*b* are mounted on the outer side of the end plates 16*a*, 16*b*, the inner ports 102*a*, 102*b* of the end plates 16*a*, 16*b* can be prevented from being blocked by the stopper members 18*a*, 18*b* and becoming unusable.

What is claimed is:

1. A rodless cylinder, comprising:

a cylinder tube having a bore;

a piston provided along said bore;

a slide table coupled to said piston to reciprocate along said cylinder tube with movement of said piston, said slide table being integrally formed and having an upper surface providing a base thereof to which other members are selectively attached;

an end plate mounted to an end of said cylinder tube to block said bore, wherein said end plate comprises an inner port in communication with said bore;

a stopper member mounted to the end of said cylinder tube through said end plate, wherein said stopper member comprises an outer port in communication with said inner port;

a non-shock-absorbing adjuster bolt provided in said stopper member to restrict a moving range of said slide table; and a shock absorber mounted in said stopper member at a different position from said adjuster bolt, to buffer an impact when said slide table contacts said adjuster bolt, wherein said stopper member projects with respect to a surface of said cylinder tube such that an upper surface of said stopper member is set at a level which is lower than said upper surface of said slide table when no other members are attached to said base of said slide table.

2. The rodless cylinder according to claim 1, wherein said stopper member is provided with a screw member applying force in a direction to reduce a width of a slit portion such that said shock absorber is secured at a predetermined position by said screw member.

3. The rodless cylinder according to claim 1, wherein said end plate and said stopper member are attached integrally to said cylinder tube by a screw member.

4. The rodless cylinder according to claim 1, wherein said bore is formed to have an approximately rhombic cross section, a thinned portion is formed in a vicinity of a side of said bore at an outer surface of said cylinder tube, and said adjuster bolt and said shock absorber are provided along said thinned portion.

5. The rodless cylinder according to claim 4, wherein a ratio of a thickness of said cylinder tube relative to a width thereof approximately perpendicular to an axial line is at most about 50%, and said cylinder tube is formed to be approximately symmetrical relative to a plane extending through a center of said slide table and said cylinder tube in a direction of movement of said slide table.

6. The rodless cylinder according to claim 1, wherein said stopper member is detachably attached to said end plate by a screw member.

7. A rodless cylinder, comprising:

a cylinder tube having a bore;

a piston provided along said bore;

a slide table coupled to said piston to reciprocate along said cylinder tube with movement of said piston;

an end plate mounted to an end of said cylinder tube to block said bore;

a stopper member mounted to the end of said cylinder tube through said end plate;

an adjuster bolt provided in said stopper member to restrict a moving range of said slide table, wherein said end plate comprises an inner port in communication with said bore, and said stopper member comprises an outer port in communication with said inner port.

8. The rodless cylinder according to claim 7, wherein said end plate and said stopper member are attached integrally to said cylinder tube by a screw member.

9. The rodless cylinder according to claim 7, wherein said stopper member is detachably attached to said end plate by a screw member.

10. The rodless cylinder according to claim 7, wherein said stopper member is provided with a shock absorber to buffer an impact when said slide table contacts said adjuster bolt.

11. The rodless cylinder according to claim 10, wherein said stopper member is provided with a screw member applying force in a direction to reduce a width of a slit portion such that said shock absorber is secured at a predetermined position by said screw member.

12. The rodless cylinder according to claim 10, wherein said bore is formed to have an approximately rhombic cross section, a thinned portion is formed in a vicinity of a side of said bore at an outer surface of said cylinder tube, and said adjuster bolt and said shock absorber are provided along said thinned portion.

13. The rodless cylinder according to claim 12, wherein a ratio of a thickness of said cylinder tube relative to a width thereof approximately perpendicular to an axial line is at most about 50%, and said cylinder tube is formed to be approximately symmetrical relative to a plane extending through a center of said slide table and said cylinder tube in a direction of movement of said slide table, and said stopper member projects with respect to a surface of said cylinder tube such that an upper surface of said stopper member is set at a level which is lower than an upper surface of said slide table.

* * * * *